US006044817A

United States Patent [19]

Hiraoka et al.

[11] Patent Number: 6,044,817

[45] Date of Patent: Apr. 4, 2000

[54] CAMSHAFT AND ACCESSORY DRIVE ARRANGEMENT FOR ENGINE POWERING AN OUTBOARD MOTOR

[75] Inventors: Noriyoshi Hiraoka; Masanori Takahashi, both of Hamamatsu, Japan

[73] Assignee: Sanshin Kogyo Kabushiki Kaisha, Japan

[21] Appl. No.: 09/019,398

[22] Filed: Feb. 5, 1998

[30] Foreign Application Priority Data

Feb. 5, 1997 [JP] Japan ..... 9-022415

[51] Int. Cl.[7] ..... F02B 77/00; F01L 1/00

[52] U.S. Cl. ..... 123/90.31; 123/198 R

[58] Field of Search ..... 123/90.16, 90.17, 123/90.31, 198 R; 440/83

[56] References Cited

U.S. PATENT DOCUMENTS

| | | | |
|---|---|---|---|
| 5,197,427 | 3/1993 | Masuda et al. | 123/559.1 |
| 5,231,961 | 8/1993 | Shimada et al. . | |
| 5,370,563 | 12/1994 | Yamazaki et al. . | |
| 5,704,819 | 1/1998 | Isogawa . | |
| 5,724,936 | 3/1998 | Osakabe | 123/198 R |
| 5,752,866 | 5/1998 | Takahashi et al. | 123/195 HC |
| 5,755,606 | 5/1998 | Takahashi et al. . | |
| 5,778,847 | 7/1998 | Takahashi et al. | 123/195 P |

*Primary Examiner*—Willis R. Wolfe
*Assistant Examiner*—Jason Benton
*Attorney, Agent, or Firm*—Knobbe, Martens, Olson & Bear, LLP

[57] ABSTRACT

A drive arrangement for an engine of an outboard motor including a cowling and a water propulsion device is disclosed. The engine is positioned in the cowling and has a body having a top end and a bottom end and defining at least one combustion chamber. The engine has a generally vertically extending crankshaft having a bottom end in driving relation with the water propulsion device and a top end extending above the top end of the body of the engine, the engine including an intake system including an intake passage through which air is provided to each combustion chamber, at least one intake valve for controlling the flow through the intake passage, and an intake camshaft for actuating the intake valve(s). The engine also includes an exhaust system including an exhaust passage leading from each combustion chamber, at least one exhaust valve for controlling the flow of exhaust through the exhaust passage, and an exhaust camshaft for actuating the exhaust valve(s). The drive arrangement includes a flywheel positioned on the crankshaft adjacent the top end of the engine and a camshaft drive pulley positioned on the crankshaft above the flywheel, the camshaft drive pulley driving a first flexible transmitter which drives a driven pulley connected to at least one of the camshafts, the crankshaft further arranged to drive a second flexible transmitter which drives a pulley associated with an engine accessory such as an alternator.

8 Claims, 7 Drawing Sheets

CAMSHAFT AND ACCESSORY DRIVE ARRANGEMENT FOR ENGINE POWERING AN OUTBOARD MOTOR

FIELD OF THE INVENTION

The present invention relates to an engine of the type utilized to power an outboard motor. More particularly, the invention is a camshaft and accessory drive arrangement for such an engine.

BACKGROUND OF THE INVENTION

Internal combustion engines are commonly utilized to power the propeller of an outboard motor. In these types of motors, the engine is mounted in an enclosure formed by a cowling. The engine is oriented with its crankshaft vertically extending, with a bottom end of the crankshaft arranged to drive a drive shaft. This drive shaft extends through a lower portion of the motor to a transmission for selectively driving the propeller.

These types of motors are normally mounted to a transom portion of the hull of a watercraft at the stem of the craft. The motor is pivotally connected to the watercraft so that the depth of the propeller in the water may be adjusted, or the propeller may be entirely removed from the water.

In this arrangement, the cowling portion of the motor which houses the engine is generally above the pivot point or axis. Due to the weight of the engine, the pivoting of the motor can be rather difficult. It is, therefore, generally desirable for the engine to have as low of a center of gravity as possible.

This desire is made difficult by the orientation of the engine in which the crankshaft is vertically extending. In particular, a number of accessories or other engine features are often driven off of the crankshaft, and when these features are positioned at or above the top end of the engine the center of gravity is raised.

Another problem associated with the vertically extending crankshaft is that an excessively large bending force or moment may be applied to the crankshaft if it extends too far beyond the top or bottom of the engine and is used to drive other engine features. This may cause damage to the crankshaft, mounting bearings or the like.

It is, therefore, an object of the present invention to provide a camshaft and accessory drive arrangement for an engine powering an outboard motor where the drive arrangement reduces the bending forces applied to the crankshaft and maintains a lower engine center of gravity.

SUMMARY OF THE INVENTION

In accordance with the present invention, there is provided a camshaft and accessory drive arrangement for an engine powering an outboard motor which has a cowling and a water propulsion device.

The engine is positioned in the cowling and has a body having a top end and a bottom end and defining at least one combustion chamber. The engine has a generally vertically extending crankshaft having a bottom end in driving relation with the water propulsion device and a top end extending above the top end of the body of the engine.

The engine also includes an intake system including an intake passage through which air is provided to each combustion chamber and at least one intake valve for controlling the flow of air through the intake passage. At least one intake camshaft actuates the at least one intake valve. The engine includes an exhaust system including an exhaust passage leading from each combustion chamber and at least one exhaust valve for controlling the flow of exhaust through the exhaust passage. At least one exhaust camshaft actuates the at least one exhaust valve.

The drive arrangement includes a flywheel positioned on the crankshaft adjacent the top end of the engine and a camshaft drive pulley positioned on the crankshaft above the flywheel. The camshaft drive pulley drives a first flexible transmitter which drives a driven pulley connected to at least one of the camshafts, the crankshaft further arranged to drive a second flexible transmitter which drives a pulley associated with an accessory of the engine.

Further objects, features, and advantages of the present invention over the prior art will become apparent from the detailed description of the drawings which follows, when considered with the attached figures.

DETAILED DESCRIPTION OF THE PREFERRED EMBODIMENTS OF THE INVENTION

In accordance with the present invention, there is provided an outboard motor powered by an engine having a camshaft and accessory drive arrangement in accordance with the present invention. The engine having the drive arrangement is described for use with an outboard motor since this particular application is one requiring the compact arrangement of the engine described. It should be understood, however, that an engine including the drive arrangement may be used in a variety of other applications.

Figure 1:
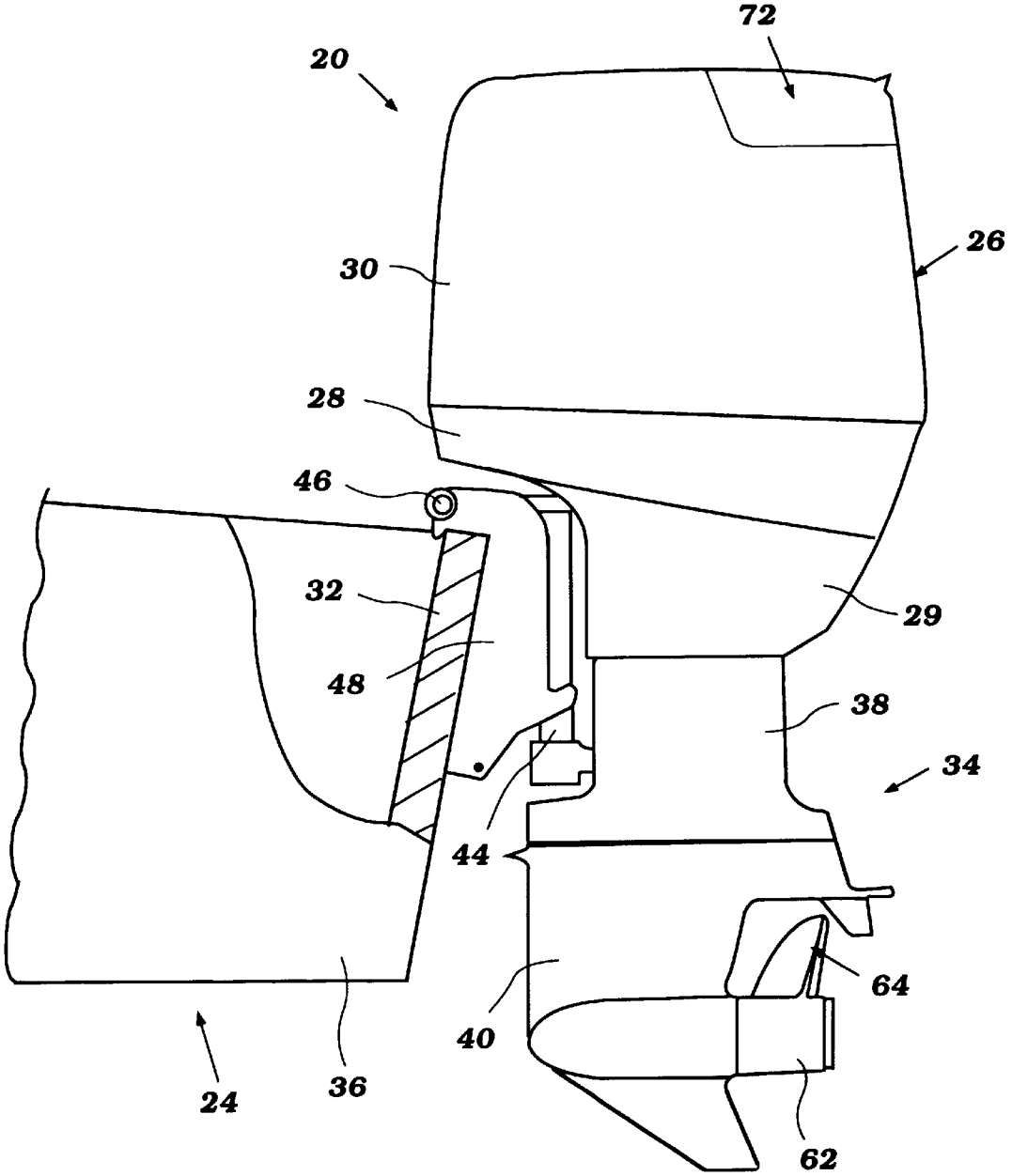
FIG. 1 is a side view of an outboard motor connected to a hull, illustrated partially in cross-section, of a watercraft.

As illustrated in FIG. 1, the outboard motor 20 is of the type utilized to propel a watercraft 24. The outboard motor 20 has a powerhead area 26 comprised of upper and lower cowling portions 28,30. The motor 20 includes a lower unit 34 extending downwardly from the cowling portion 30. The lower unit 34 comprises an upper or "drive shaft housing" section 38 and a lower section 40. An apron 29 is positioned between the powerhead 26 and lower unit 34.

The motor 20 is connected to a steering shaft (not shown). The steering shaft is supported for steering movement about a vertically extending axis within a swivel or steering bracket 44, permitting movement of the motor 20 to the left and right for steering the watercraft 24 to which it is attached.

The swivel bracket 44 is connected by means of a pivot pin 46 to a clamping bracket 48 which is attached to a transom portion 32 of a hull 36 of the watercraft 24. The pivot pin 46 permits the outboard motor 20 to be trimmed and tilted up about the horizontally disposed axis formed by the pivot pin 46.

Figure 2:
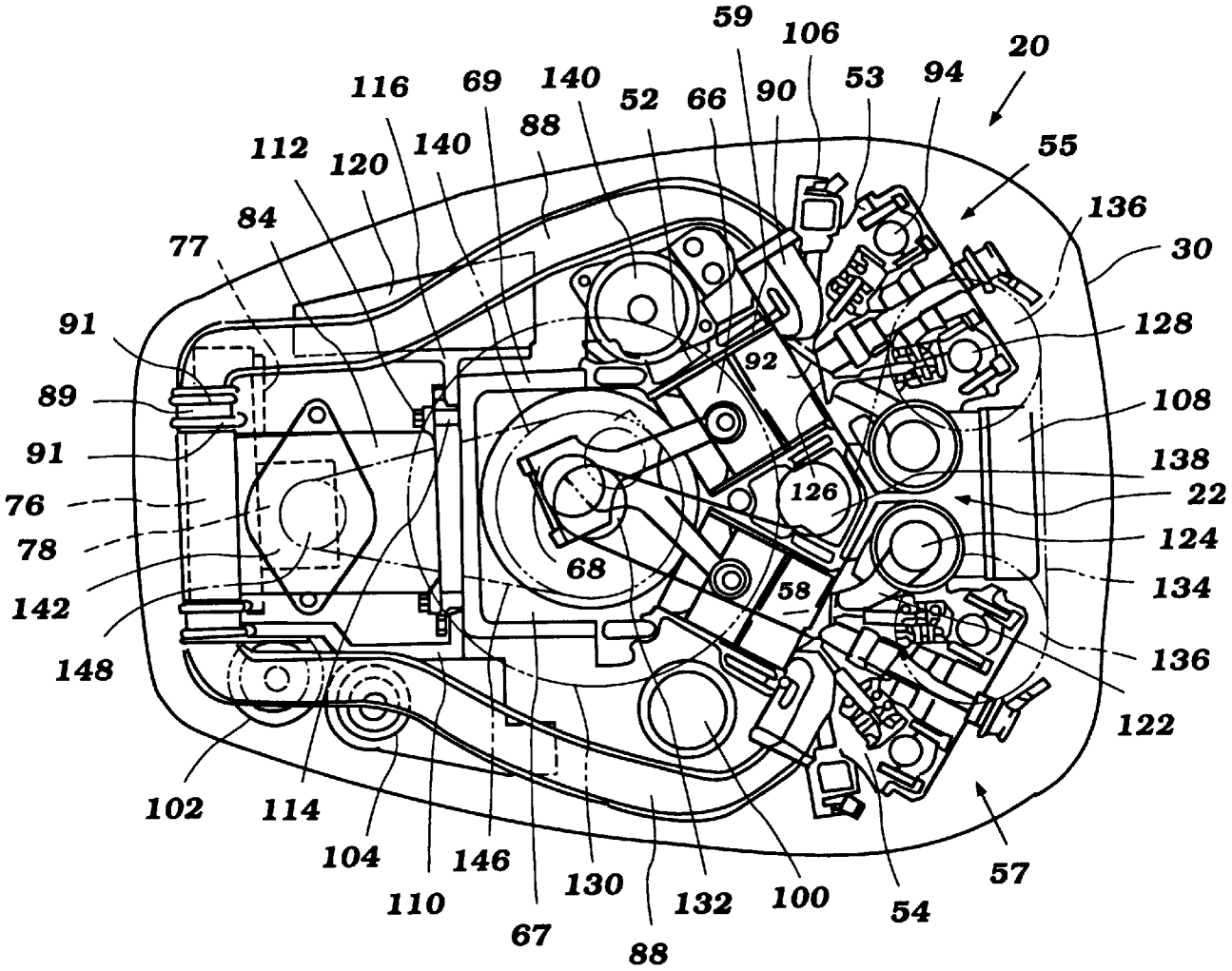
FIG. 2 is a top cross-sectional view of the motor and engine therein, the engine having a camshaft and accessory drive arrangement in accordance with the present invention.

Referring to FIG. 2, the power head 26 of the outboard motor 20 includes the engine 22 which is positioned within the cowling portion 30. The engine 22 is preferably of the six-cylinder variety arranged in a "V" fashion. Preferably, the engine 22 operates on a four-cycle principle. Those of skill in the art will appreciate that the engine 22 may have a greater or lesser number of cylinders, be arranged in other than "V" fashion, and operate in accordance with other principles, such as two-cycle or rotary principles.

In this arrangement, the engine 22 has a cylinder block 52 with a first cylinder head 53 and a second cylinder head 54 connected thereto and cooperating therewith to define first and second cylinder banks 55,57 defining a valley therebetween. This valley faces away from the watercraft to which the motor 20 is attached.

The cylinder block 52 defines three cylinders 59 in each bank. As described in more detail below, a piston 66 is movably positioned in each cylinder 59. A combustion chamber 58 is defined by the top of each piston 66, a respective cylinder head 53,54 and the wall of the block 52 defining each cylinder 59.

Each piston 66 is connected to a connecting rod 68 extending to a vertically extending (i.e. along a vertical axis "V" as illustrated in FIG. 2) crankshaft 56. The crankshaft 56 is arranged to drive a water propulsion device associated with the motor 20. Preferably, this water propulsion device comprises a propeller 64 (see FIG. 1).

Figure 3:
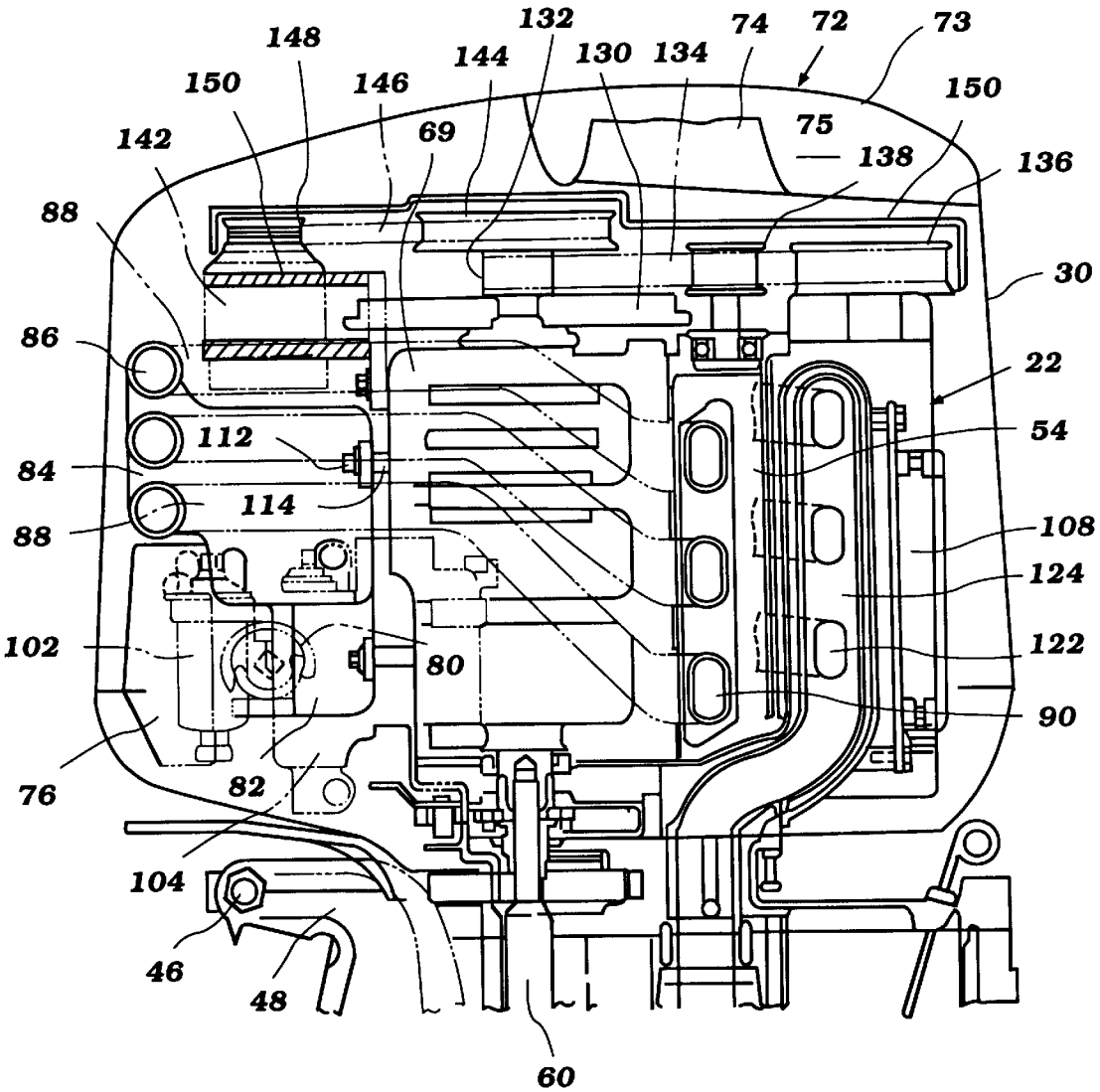
FIG. 3 is a cross-sectional view of a first side of a powerhead portion of the motor illustrated in FIG. 1, with portions of the engine also illustrated in cross-section.

Referring to FIG. 3, the crankshaft 56 extends below the engine 22 where it is connected to a drive shaft 60. Though not shown, the drive shaft 60 extends downwardly through the lower unit 34, where it drives a bevel gear and a conventional forward-neutral-reverse transmission. A control (not shown) is preferably provided for allowing an operator to remotely control the transmission from the watercraft 24. The transmission drives a propeller shaft which is journalled within the lower section 40 of the lower unit 34 in a known manner. Referring to FIG. 1, a hub 62 of the propeller 64 is coupled to the propeller shaft for providing a propulsive force to the watercraft 24 in a manner well known in this art.

Referring again to FIG. 2, the crankshaft 56 is journalled for rotation with respect to the cylinder block 52. A crankcase cover 69 engages an end of the block 52 generally opposite the heads 53,54, (i.e., on the side of the engine closest the watercraft 24) defining therewith a crankcase chamber 67 within which the crankshaft 56 rotates. The crankcase cover 69 may be attached to the cylinder block 52 by bolts or similar means for attaching known to those skilled in the art.

The engine 22 includes an air intake system for providing air to each combustion chamber 58. The intake system is preferably positioned at the crankcase or watercraft end of the engine 22. Referring to FIGS. 1 and 3, air passes through a vent 72. The vent 72 includes a vent cowling 73 having one or more slots or passages therethrough. The vent cowling 73 cooperates with the upper cowling 30 to define an intake chamber 75. An upstanding inlet pipe 74 extends into the chamber 75 and defines a passage leading therethrough from the chamber 75 to the space surrounding the engine 22.

Figure 4:
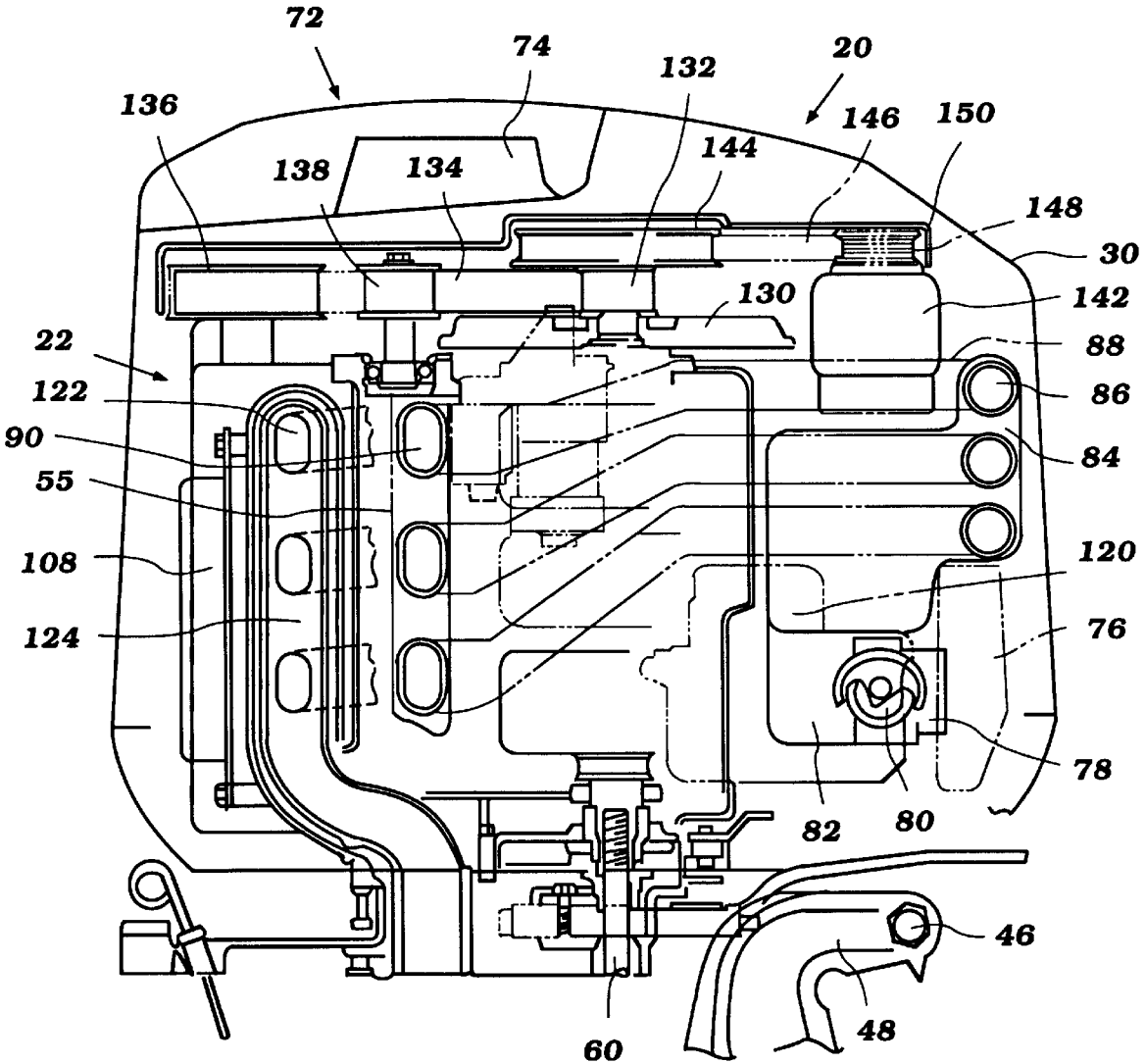
FIG. 4 is a cross-sectional view of a second side of the powerhead portion of the motor illustrated in FIG. 1.
Figure 5:
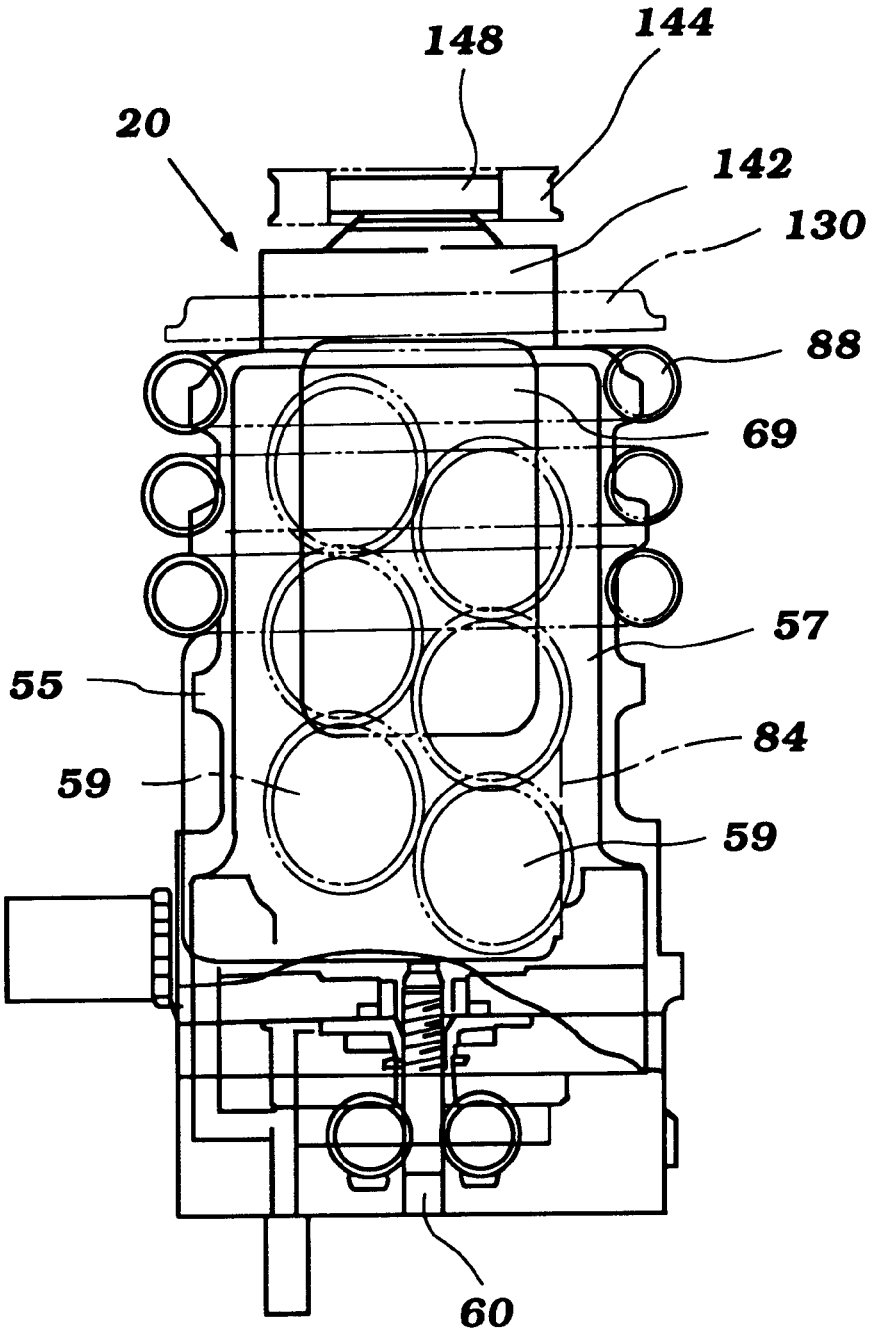
FIG. 5 is an end view, in partial cross-section, of the engine powering the motor illustrated in FIG. 1.

Referring to FIGS. 2–4, air is drawn from around the engine 22 into an opening 77 (see FIG. 2) of a silencer 76. As illustrated in FIG. 4, the silencer 76 is positioned near a bottom of the powerhead 26. Air flowing through the silencer 76, which may include a filter element, passes into a generally horizontal extending throttle body 78. A throttle valve 80 is associated with the body 78 for controlling the air flow rate therethrough. The valve 80 is preferably remotely operable from a control (not shown).

Air passing through the throttle body 78 flows into a lower section 82 of a single surge tank 84. A port 86 is provided in the surge tank 84 corresponding to each cylinder 59. An intake runner 88 extends from each port 86 to an intake passage 90 leading through a respective cylinder head 53,54 to a cylinder. There are thus three runners 88 corresponding to each bank 55,57. A first group of three runners 88 extends from one side of the surge tank 84 along the outside of the engine 22 to the first cylinder head 53, and a second group of three runners 88 extends from the opposite side of the surge tank 84 to the second cylinder head 54.

Referring primarily to FIG. 2, each runner 88 is connected to the surge tank 84 with a connecting part 89. An adjustable band 91 is preferably utilized to tighten the connection of the connecting part 89 to the runner 88 and to the tank 84, respectively.

Still referring primarily to FIG. 2, means are provided for controlling the flow of air through each intake passage 90 into its corresponding combustion chamber 58. Preferably, this means comprises at least one intake valve 92 corresponding to each intake passage 90. As illustrated, all of the intake valves 92 for each bank 55,57 of cylinders are preferably actuated by a single intake camshaft 94. Each intake camshaft 94 is mounted for rotation with respect to its respective cylinder head 53,54 and connected thereto with at least one bracket. Each intake camshaft 94 preferably rotates within an enclosure defined by the cylinder head 55,57 and a camshaft cover connected thereto.

As is well known to those of skill in the art, each intake valve 92 has a head which is adapted for seating against a valve seat in the passage 90, and a stem extending from the head through a valve guide to a follower. A spring is positioned between the follower and a portion of the cylinder head 53,54 for biasing the valve 92 upwardly into a closed position.

Means are provided for rotating each camshaft 94, as described in more detail below.

Fuel is supplied to the incoming air with a fuel supply system. Preferably, a pump 100 draws fuel from a fuel supply (such as a fuel tank positioned in the watercraft 24) and delivers it through a filter 102 to a vapor separator 104. Fuel is supplied from the separator 104 under high pressure (such as by a high pressure pump mounted in the separator) to a fuel injector 106. As illustrated, an injector 106 is provided corresponding to each intake passage 90 and delivers fuel into the air passing therethrough.

It is noted that the individual fuel lines or pipes interconnecting the various portions of the fuel system are not illustrated in the figures, these features being well known to those of skill in the art and forming no part of the invention herein. It is also noted that, as well known to those of skill in the art, the fuel may be supplied to the engine with other than fuel injector(s), such as a carburetor, or the fuel injector(s) may be arranged to deliver fuel directly into each combustion chamber 58 or into a common manifold area.

Preferably, control means are provided for selectively opening a valve associated with each injector 106 for controlling the timing and quantity of fuel delivered therethrough into the air passing through the passage 90. This mean may comprise an electronic control unit (ECU) or other electronic control 108. Preferably, the ECU 108 is mounted to the engine 22 positioned in the valley between the banks 54,55.

As illustrated, the filter 102, vapor separator 104 and an electronics box 120 are all mounted directly to the engine 22. A first mount 110 is preferably connected to the crankcase cover 69 with one or more bolts 112 connected to a boss portion 114 of the cover 69. This first mount 110 extends outwardly from the engine 22 for mounting of the filter 102 and separator 104, as illustrated in FIG. 3.

A generally "T"-shaped mount 116 is preferably mounted to the crankcase cover 69 generally opposite the first mount 110. The electronics box 120 is preferably connected to this mount 116. This box 120 may contain electronics relating to an ignition system, fuel pump control or the like.

The fuel and air mixture which is delivered to each combustion chamber 58 is preferably ignited with an ignition system. This system is not described herein and may be of a variety of types well known to those of skill in the art.

Referring to FIGS. 2–4, an exhaust system is provided for routing the products of combustion within the combustion chambers 58 to a point external to the engine 22. In particular, an exhaust passage 122 leads from each combustion chamber to a main exhaust passage 124 corresponding to each bank 55,57. The main passage 124 corresponding to each bank 55,57 is preferably defined by the cylinder head 53,54 corresponding thereto. Each passage 124 leads downwardly through the to the bottom of the engine. Thereafter, though not shown in detail, the exhaust from each bank 55,57 passes through a passage through an exhaust guide positioned at the bottom end of the engine, and thereafter into the lower unit 34 of the motor 20 to an appropriate above or below the water discharge.

Referring still to FIG. 2, means are also provided for controlling the flow of exhaust from each combustion chamber 58 to its respective exhaust passage 122. Preferably, this means comprises at least one exhaust valve 126. Like the intake valves 92, the exhaust valves 126 of each cylinder bank are preferably all actuated by a single exhaust camshaft 128. Each exhaust camshaft 128 is journalled for rotation with respect to its respective cylinder head 53,54 and connected thereto with at least one bracket. Each exhaust camshaft 128 is preferably enclosed within the same camshaft cover which covers the adjacent intake camshaft 94.

Like each intake valve 92, each exhaust valve 126 preferably includes a head for selective positioning against a valve seat in the passage 122. A stem extends from the head of the valve 96 through a valve guide in the cylinder head 53,54. A follower is positioned at the opposite end of the stem for engagement by the camshaft 128. A spring is positioned between the follower and the cylinder head 53,54 for biasing the valve 122 into its closed position.

As best illustrated in FIGS. 1 and 2, means are provided for driving the camshafts 94,128. Preferably, each camshaft 94,128 is driven by the crankshaft 56.

In this arrangement, the crankshaft 56 is journalled at the top end of the cylinder block 52 and extends above or beyond the top end of the engine 22. A flywheel 130 is maintained in position on the crankshaft 56 just above the cylinder block wall.

At least one camshaft is preferably driven by a flexible transmitter, such as a belt or chain. Preferably, the camshaft drive includes a camshaft drive pulley 132 connected to the crankshaft 56 above the flywheel 130 which drives a belt 134, the belt 134 in turn driving a driven pulley 136 mounted to the end of each of the exhaust camshafts 128.

Preferably, the belt 134 is routed around an idler pulley 138. As best illustrated in FIG. 2, the idler pulley 138 is positioned in the valley of the engine 22. The idler pulley 138 may comprise a pulley wheel mounted to a rotatable support shaft. In this arrangement, the belt 134 extends from the camshaft drive pulley 132 around a part of the idler pulley 136 to a first of the driven pulleys 136, across to the second driven pulley 136 and then back to the drive pulley 132.

In this arrangement, the crankshaft 56 directly drives each of the exhaust camshafts 128 with the drive belt 134. The exhaust camshaft 128 of each bank 55,57 is then preferably arranged to drive the corresponding intake camshaft 94 of that bank through a suitable gear system. For example, although not shown, a gear may be mounted to the bottom end of the intake and exhaust camshafts 94,128 of each bank 55,57 in interengagement, whereby rotation of the exhaust camshaft 128 effects rotation of the intake camshaft 94.

As illustrated in FIG. 2, the engine 22 may include additional engine auxiliary features or accessories such as a starter motor 140 and an alternator 142. Preferably, the starter motor 140 is positioned for engagement with the flywheel 130 for use in starting the engine 22, as is well known to those skilled in the art.

The alternator 142 is preferably utilized to produce electricity for firing the spark plugs and similar functions. The alternator 142 is driven by the crankshaft 56 in accordance with the drive arrangement of the present invention.

In accordance with this invention, a second or accessory drive pulley 144 connected to the crankshaft 56. Preferably, this pulley 144 is positioned above the first drive pulley 132. A flexible transmitter 146 is driven by this pulley 144 and drives an alternator pulley 148.

In this embodiment, the alternator 142 is positioned at the crankcase end of the engine 22 and connected thereto with one or more brackets 150. So that the alternator pulley 148 is positioned in the same horizontal plane as the belt 146, the top of the surge tank 84 has a recessed area to accommodate a portion of the alternator 142, as best illustrated in FIG. 4.

So arranged, the alternator drive belt 146 extends in a first direction from the crankshaft 56, while the camshaft drive belt 134 extends in generally the opposite direction therefrom.

Preferably, a cover 150 extends over the entire accessory and camshaft drive of the engine 22, as best illustrated in FIG. 4. The cover 150 protects an operator of the motor 20 from opening the cowling 30 and being exposed to the rotating belts and pulleys associated with the drive, protecting the operator. In addition, the cover 150 may cooperate with the intake 74 to guide cool incoming air into the space surrounding the drive belts for cooling the belts and associated components.

Advantageously, this camshaft and accessory drive arrangement aids in providing a low center of the gravity for the engine and reducing or minimizing the bending forces on the crankshaft 56. First, the larger mass flywheel is positioned along the crankshaft 56 very close to the engine 22, keeping the center of gravity of the engine low and reducing the bending forces applied to the crankshaft 56 generated by rotation of the flywheel 130. The smaller mass drive pulleys 132,144 are mounted above the flywheel 130, but still permitting the crankshaft 56 to extend minimally above its support of at the top wall of the cylinder block 52. Because the force necessary to drive the belt 134 associated with the camshafts is generally larger than that necessary to drive the alternator 142, the camshaft drive pulley 132 is mounted close to the flywheel 130 not far along the crankshaft, thus again minimizing bending forces.

In addition, the direction of the forces upon the crankshaft 56 from driving the accessory and camshaft drive pulleys 144, 132 are generally opposite, helping to cancel some of the applied bending moments.

Though not shown, the engine 22 may be provided with a lubricating system for providing lubricant to the various portions of the engine. In addition, though not described or illustrated herein in detail, the engine 22 preferably includes a suitable cooling system as well known to one of skill in the art.

Figure 6:
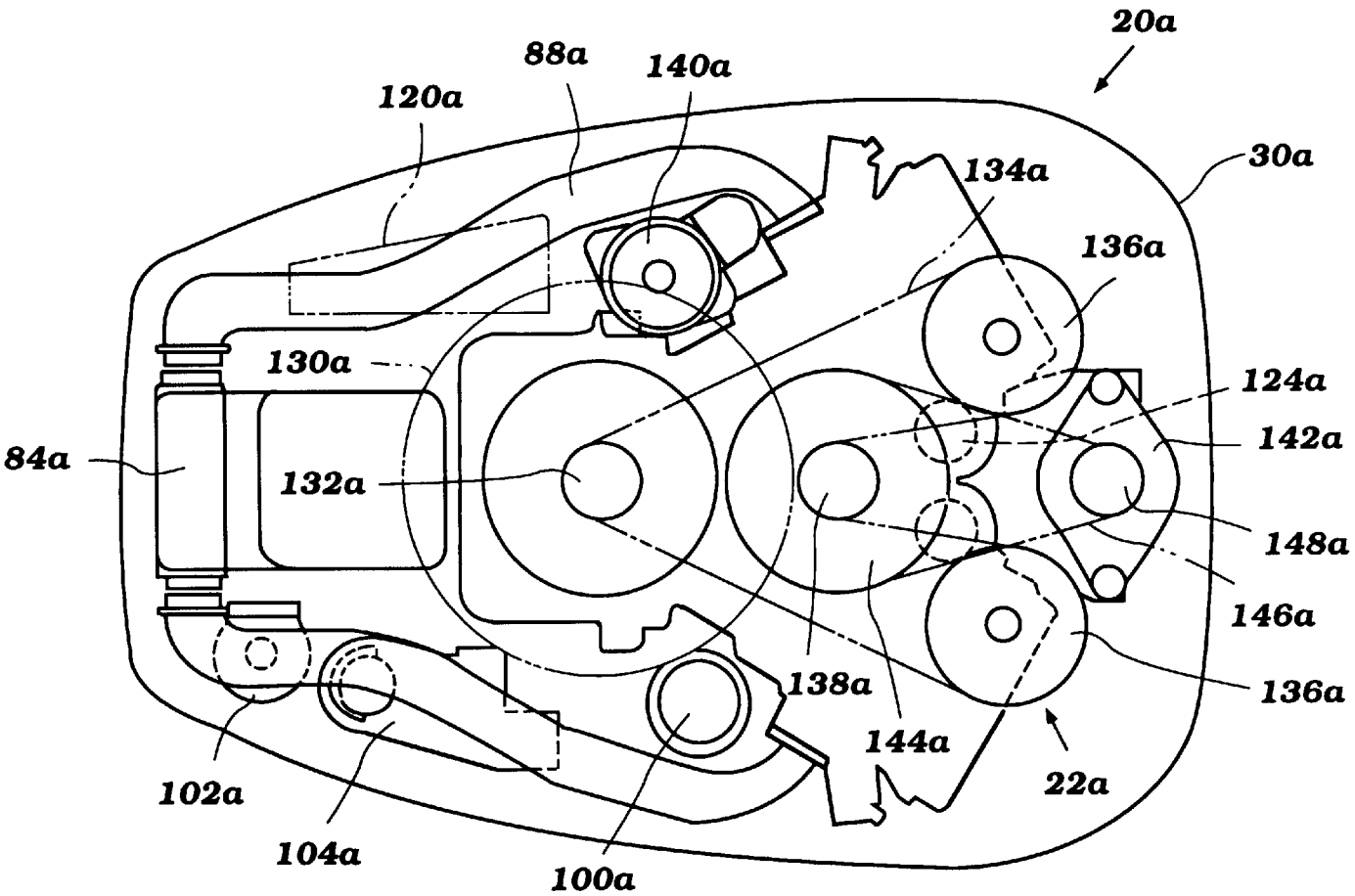
FIG. 6 is a cross-sectional top view of a motor similar to that illustrated in FIG. 1, exposing a top of an engine therein having a camshaft and accessory drive arrangement in accordance with a second embodiment of the present invention.
Figure 7:
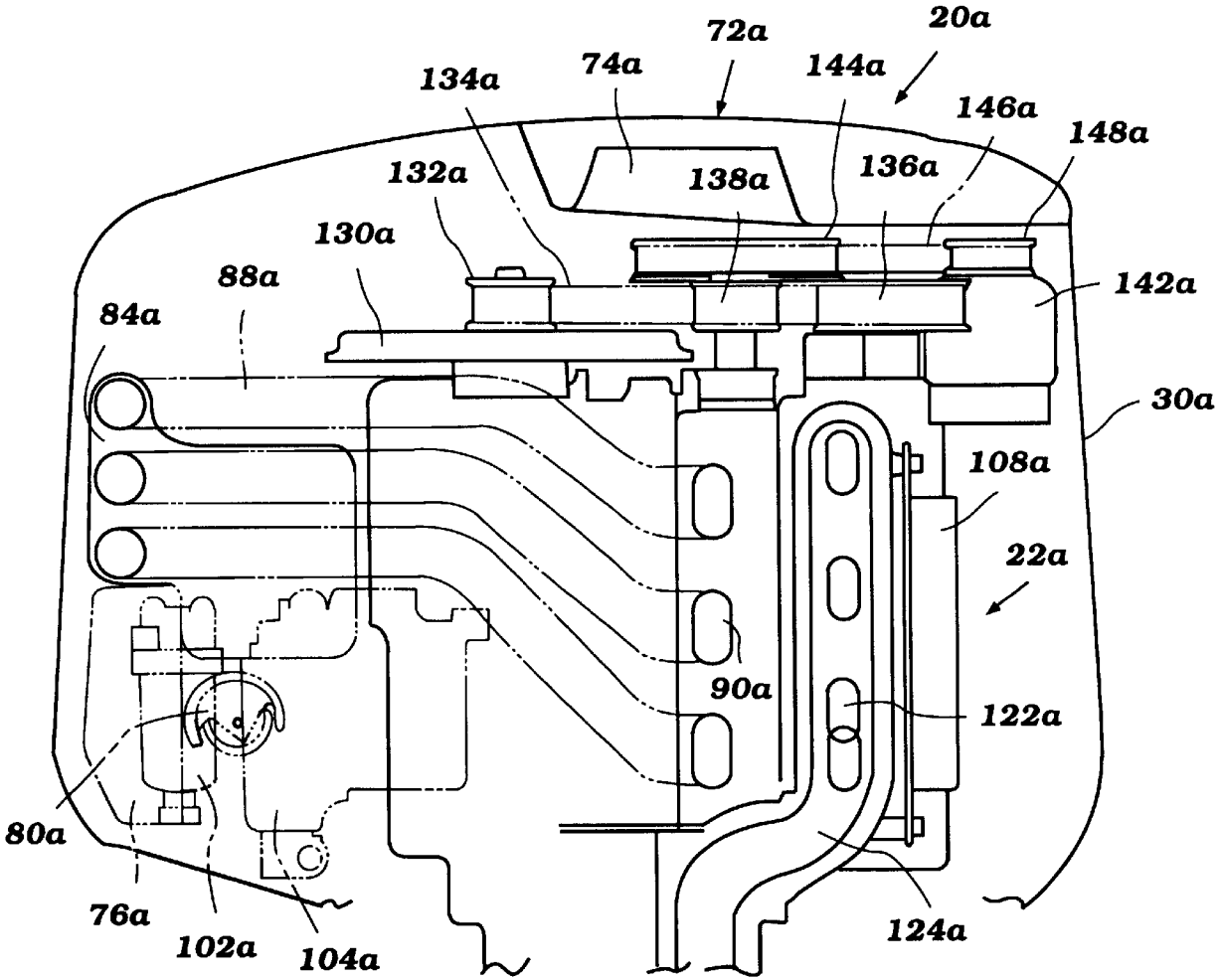
FIG. 7 is a cross-sectional view of a first side of the powerhead portion of the motor illustrated in FIG. 6.

FIGS. 6 and 7 illustrate a camshaft and accessory drive arrangement in accordance with a second embodiment of the present invention. In the description and illustrations of this embodiment of the invention, like reference numerals will be used to identify like or similar elements to those of the first embodiment, except that an "a" designator has been added thereto.

This embodiment camshaft and accessory drive is similar to that of the first embodiment in that a flywheel 104*a* is positioned on the crankshaft 56*a* just above a top end of the cylinder block of the engine 22*a*. In addition, a drive pulley 132*a* is positioned on the crankshaft 56*a* above the flywheel 104*a*. A first belt 134*a* is driven by the camshaft drive pulley 132*a*, the belt 134*a* extending first to one of the camshaft driven pulleys 136*a*, then to the idler pulley 138*a*, then to the other driven pulley 136*a* before extending back to the drive pulley 132*a*. In this manner, the crankshaft 56*a* drives the camshafts.

In this arrangement, however, the accessory drive pulley 144*a* is not connected to the crankshaft 56*a*, but is instead mounted on the same shaft as the idler pulley 138*a*. As the belt 134*a* drives the idler pulley 138*a*, the accessory drive pulley 144*a* is simultaneously rotated and drives the alternator belt 146*a* which drives the alternator 142*a*.

In this arrangement, the alternator 142*a* is preferably mounted at the end of the engine 22*a* at which the "V" is formed (i.e. opposite the crankcase end), such as by an appropriate mount.

This drive arrangement is advantageous for similar reasons to those of the first embodiment, and in addition has the further advantage that the crankshaft 56*a* need not extend as far out from the engine 22*a* since only the flywheel 130*a* and camshaft drive pulley 132*a* (and not in addition the accessory drive pulley 144*a*) are mounted thereon. This reduces the bending moments applied to the crankshaft 56*a* (the size of which depend on the magnitude of the applied force and distance of application from the crankshaft support at the cylinder block wall).

Of course, the foregoing description is that of preferred embodiments of the invention, and various changes and modifications may be made without departing from the spirit and scope of the invention, as defined by the appended claims.

What is claimed is:

1. A drive arrangement for an engine of an outboard motor, the motor including a cowling and a water propulsion device, the engine positioned in said cowling and having a body having a top end and a bottom end and defining at least one combustion chamber, said engine having a generally vertically extending crankshaft having a bottom end in driving relation with said water propulsion device and a top end extending above said top end of said body of said engine, said engine including an intake system including an intake passage through which air is provided to each combustion chamber, at least one intake valve for controlling the flow through said intake passage, and at least one intake camshaft for actuating said at least one intake valve and an exhaust system including an exhaust passage leading from each combustion chamber, at least one exhaust valve for controlling the flow of exhaust through said exhaust passage, and at least one exhaust camshaft for actuating said at least one exhaust valve, said engine including at least one accessory driven thereby, said drive arrangement including a flywheel positioned on said crankshaft adjacent said top end of said engine and a camshaft drive pulley positioned on said crankshaft above said flywheel, said camshaft drive pulley driving a first flexible transmitter which drives a driven pulley connected to at least one of said camshafts, said crankshaft further arranged to drive a second flexible transmitter which drives a pulley associated with said accessory.

2. The drive arrangement in accordance with claim 1, wherein said accessory comprises an alternator.

3. The drive arrangement in accordance with claim 1, wherein said engine is of the "V" type having a first bank defining at least one combustion chamber and a second bank defining at least one combustion chamber.

4. The drive arrangement in accordance with claim 3, wherein each bank includes an intake camshaft and an exhaust camshaft.

5. The drive arrangement in accordance with claim 4, wherein said first flexible transmitter drives a driven pulley connected to one camshaft of each bank.

6. The drive arrangement in accordance with claim 1, wherein an accessory drive pulley is connected to said crankshaft above said camshaft drive pulley, said accessory drive pulley driving said second flexible transmitter.

7. The drive arrangement in accordance with claim 1, further including an idler pulley, said first flexible transmitter engaging said idler pulley.

8. A drive arrangement for an engine of an outboard motor, the motor including a cowling and a water propulsion device, the engine positioned in said cowling and having a body having a top end and a bottom end and defining at least one combustion chamber, said engine having a generally vertically extending crankshaft having a bottom end in driving relation with said water propulsion device and a top end extending above said top end of said body of said engine, said engine including an intake system including an intake passage through which air is provided to each combustion chamber, at least one intake valve for controlling the flow through said intake passage, and an exhaust system including an exhaust passage leading from each combustion chamber, at least one exhaust valve for controlling the flow of exhaust through said exhaust passage, and at least one camshaft for actuating said at least one of said intake and exhaust valves, said engine including at least one accessory driven thereby, said drive arrangement including a flywheel positioned on said crankshaft adjacent said top end of said engine and a camshaft drive pulley positioned on said crankshaft, said camshaft drive pulley driving a first flexible transmitter which drives a driven pulley for driving said at least one camshaft, an idler pulley, said first flexible transmitter engaging and driving said idler pulley, and an accessory drive pulley driven by said idler pulley for driving said accessory.

* * * * *